United States Patent [19]

Martin et al.

[11] 4,235,341

[45] Nov. 25, 1980

[54] SPIRALLY WOUND CONTAINER WITH STRIPPABLE LAYER

[75] Inventors: Leandra P. Martin, Granville; Robert A. Luecke, Newark, both of Ohio

[73] Assignee: The Dow Chemical Company, Midland, Mich.

[21] Appl. No.: 944,035

[22] Filed: Sep. 19, 1978

[51] Int. Cl.[3] ..... B65D 7/26

[52] U.S. Cl. ..... 206/601; 206/830; 426/122; 426/127; 426/128

[58] Field of Search ..... 206/830, 601, 629, 631; 426/118, 122, 123, 126–128

[56] References Cited

U.S. PATENT DOCUMENTS

| | | | |
|---|---|---|---|
| 2,793,126 | 5/1957 | Fienup et al. . | |
| 2,793,127 | 5/1957 | Geist et al. | 206/830 |
| 2,800,267 | 7/1957 | O'Neil | 206/830 |
| 2,891,714 | 6/1959 | Vallas | 206/830 |
| 2,975,068 | 3/1961 | Fienup et al. | 426/122 |
| 3,144,193 | 8/1964 | Geist et al. . | |
| 3,354,506 | 11/1967 | Raley | 18/14 |
| 3,423,231 | 1/1969 | Lutzmann . | |
| 3,423,341 | 1/1969 | Klare et al. | 260/22 |
| 3,933,302 | 1/1976 | Reid et al. | 206/631 |
| 3,940,496 | 2/1976 | Turpin et al. | 426/123 |
| 3,972,467 | 8/1976 | Whillock | 229/3.1 X |
| 4,025,253 | 5/1977 | Havens | 425/72 R |

FOREIGN PATENT DOCUMENTS 1257512 12/1971 United Kingdom .

*Primary Examiner*—Stephen P. Garbe
*Attorney, Agent, or Firm*—Lloyd E. Nessenaur, Jr.

[57] ABSTRACT

A spirally wound container for leavened dough and other products which is opened by side rupture. The container comprises a fiber board body having multiple thermoplastic film plies. An inner transparent ply of film adheres to the surface of the fiber board spirally wound can body and is rupturable therewith. An outer ply of film forms a label cover for the container and is strippable prior to opening of the container. After the label ply is stripped from the container, the transparent inner ply permits reading of graphics printed on the fiber body of the can. The inner film ply strengthens the body ply and acts as a moisture barrier.

6 Claims, 4 Drawing Figures

SPIRALLY WOUND CONTAINER WITH STRIPPABLE LAYER

BACKGROUND OF THE INVENTION

Pressurized cans for refrigerated dough products having a strippable label ply which, after being stripped off, permits the can to be opened along the can body seams when struck against an object or when the container is twisted, have been on the market place for a considerable number of years. Examples of such containers are those illustrated in U.S. Pat. Nos. 2,793,126; 2,793,127; and 3,144,193; for example. Some of these containers have a non-adhering portion between the strippable layer and container body so that graphics on the body will show when the label ply is stripped from the can body prior to opening as illustrated in U.S. Pat. No. 2,891,714. In these embodiments, both the can body and label plies have been of fibrous materials, one ply of which is made with fibers which can break away from the other ply where adhered together. Upon stripping, the remaining base stock is rough surfaced except in the smooth graphic area. In the multiple fiber ply thick containers of the prior art, the paper fiber strength changes with moisture level changes affecting the bond and peel strengths of the fibrous plies. Plastic laminate containers such as that shown in U.S. Pat. No. 3,972,467 are not spirally wound and the plies are not strippable.

SUMMARY OF THE INVENTION

The present invention comprises a spirally wound container having a thin paper base stock wrapped with an inner ply of film adhering to the surface of the base stock to add strength to the composite structure. The base stock can be smooth and contain graphics or indicia readable through the inner film ply which can be transparent. The outer or label ply of the can preferably comprises a thermoplastic paper substitute which is also spirally wound about the container being removable just prior to opening the container. The inner film ply is of such a plastic material and film gauge that the film will tear along with the seams when the can is ruptured upon opening. The label is tightly fitted about the container to act as additional vapor barrier and for enhancement of the container strength prior to opening.

DETAILED DESCRIPTION OF THE PREFERRED EMBODIMENTS

Figure 1:
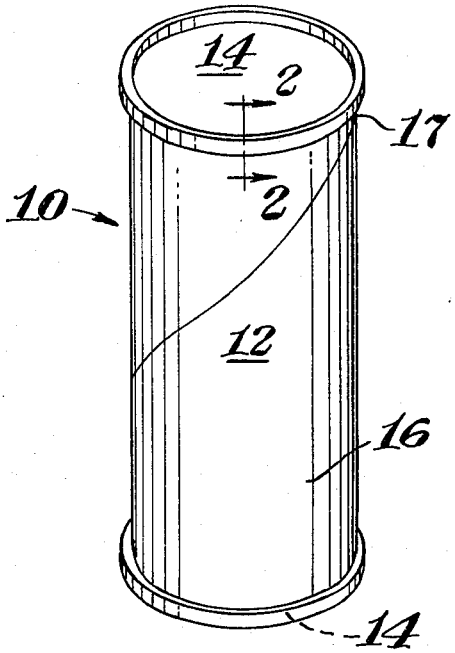
FIG. 1 is an isometric view of a container constructed according to the present invention.

Spirally wound containers for leavened dough and other products which exert pressure on the container body are commonly formed of multiple plies which can be ruptured along their seams for can opening. An improved form of such a container is that illustrated in FIGS. 1 and 2. Here new improved can or container 10 has a spirally wound tube body 12 which can be found by spirally winding the plies about a mandrel as, for example, generally shown in U.S. Pat. No. 3,940,496. The tube is closed at both ends by lids 14 commonly formed of metal. Each lid has a rolled flange 13 sealingly crimped about the ends 15 of the body 12 as taught by U.S. Pat. No. 2,891,714, for example.

Figure 4:
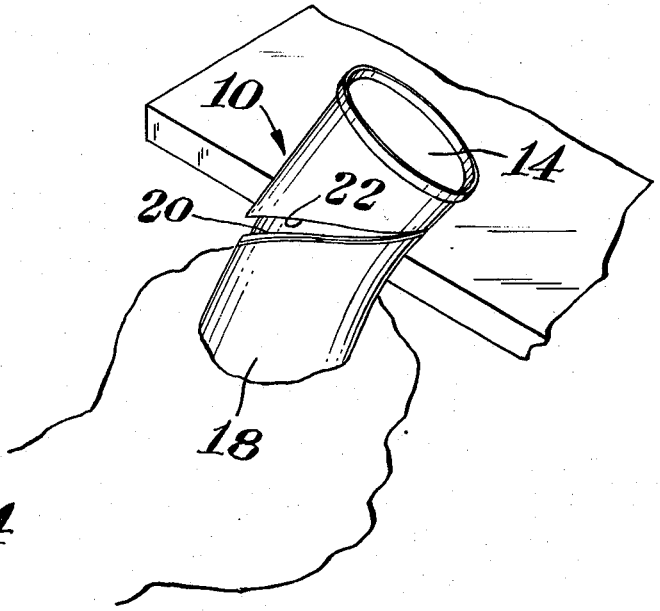
FIG. 4 is an isometric view showing the container being ruptured along a seam of the can body with the inner film ply also being ruptured when the container is opened.

Can body 12 in the preferred embodiment illustrated is of four ply construction. Outer ply 16 is commonly referred to as the label ply. The outer ply has an unglued starting tab 17 which permits stripping of the outer ply from the other plies of the container. Adjacent outer ply 16 is an inner ply 18 which is secured to a base stock or ply 20. Base ply 20 is lined by a liner 26. In the embodiment of the invention shown, the base stock 20 can be a fibrous paper or fiber board which can have glued to its inside surface an aluminum foil liner ply 26 for barrier protection of the base ply 20 against moisture contained within the product to be packaged. On the other side thereof is a cylindrical sleeve of film 18 which is preferably transparent. Both the basic base ply 20 and the liner ply 26 are spirally wound upon themselves along the length of the container. However, while plastic film ply 18 can also be spirally wound, it can instead be a continuous tubular sleeve or otherwise wrapped about the base ply in toilet roll fashion, for example. Label ply 16 is preferably spirally wound to permit its ready stripping from the rest of the can in a traditional fashion. Spiral seam 22 along body ply 20 can be perforated if desired but in most cases is generally an overlapped glued seam which will burst when the outer ply is removed and the container is twisted open or banged against a hard edge as shown in FIG. 4.

Films which can be employed as inner ply 18 either spirally wound or wound in cylindrical shape, can be thermoplastic materials such as the polyolefins disclosed in U.S. Pat. No. 3,423,341 or copolymers such as described in U.S. Pat. No. 3,423,231, particularly low density polyethylene. This film ply can be from about 0.2 mil to about 2 mils in thickness, for example. Also usable as the layer 18 can be a coextruded thermoplastic film material such as a 0.3 mil corona-treated low density polyethylene film coextruded with a 1.7 mils layer of general purpose polystyrene, for example. Inner ply 18 needs especially to be a resin or resin combination that will allow the film to adhere to the base board preferably using water-based glues. This film ply also needs to be made from a resin that is generally incompatible with the outer label ply 16 so that while it can have some degree of cling, the outer ply can still be peeled away from the inner ply as described in more detail hereinafter. Also the inner ply 18 needs to be made from a plastic material and film gauge which allows the inner film ply to tear with the body ply 20 along seams 22 of the container 10 when the container is twisted or banged against a hard surface.

Film ply 18 could be made by the method of U.S. Pat. No. 4,025,253, or if coextruded, by the method of U.S. Pat. No. 3,354,506. Because of the strength added by the film ply 18, a thinner base ply 20 can be used than would be otherwise possible. For example, the fibrous base stock of prior art containers are customarily two ply since the can body must be able to withstand internal pressures on the order of 40 to 60 pounds/square inch with safety. However, with an inner film ply 18, only a relatively thin single ply of base stock is needed for body 20 because of the strength added by film ply 18. The surface of the base stock will be smooth since the peel is between the film plies. The polyethylene film inner layer 18 can comprise a low density polyethylene having a density of about 0.922 grams/cubic centimeter and manufactured and identified as polyethylene PE 682 manufactured by The Dow Chemical Company. A typical thickness for this particular film material can be about 0.2 to about 0.4 mil.

Outer ply 16 is preferably a thermoplastic paper film such as described, for example, in British Patent No. 1,257,512. This layer contains no fibers but is instead a completely thermoplastic structure, the major component of which is preferably a polystyrene material formulated with various other materials such as a low density polyethylene resin, a block copolymer of butadiene/styrene and a pigment such as titanium dioxide. Glues such as ethylene vinyl acetate may be also added to the formulation, where additional cling is desired. Typical formulations for outer ply 16 are found below, the thickness being about 1.5 mils to about 1.8 mils:

Formulation 1
- 12% white concentrate*[1]
- 7.5% PE 682*[2]
- 5% Solprene 414*[3]
- 75.5% Styron 470D*[4]

Formulation 2
- 12% white concentrate*[1]
- 7.5% PE 682*[2]
- 5% Solprene 414*[3]
- 70.5% Styron 470D*[4]
- 5% EVA 3174*[5]

Formulation 3
- 12% white concentrate*[1]
- 7.5% PE 682*[2]
- 5% Solprene 414*[3]
- 65.5% 470D*[4]
- 10% EVA 3174*[5]

*[1]PE 682 is a high pressure low density polyethylene with a melt index of 0.7; density of 0.922 g/cc and 150 ppm of Ionol (Di-T-Butyl-P-cresol)+300 ppm Naugard 492

*[2]White concentrate is 60% $TiO_2$ in Styron ® 678 of a general purpose polystyrene with a melt flow of 12 and a vicat softening point of 194° F.

*[3]Solprene 414 is a Phillips Chemical Company product with a butadiene/styrene ratio of 60/40, with a block polystyrene 40%. The molecular weight is 130 M.

*[4]Styron ® 470D is an impact polystyrene with a melt flow rate of 3.0 g min and a vicat softening point of 212° F.

Figure 3:
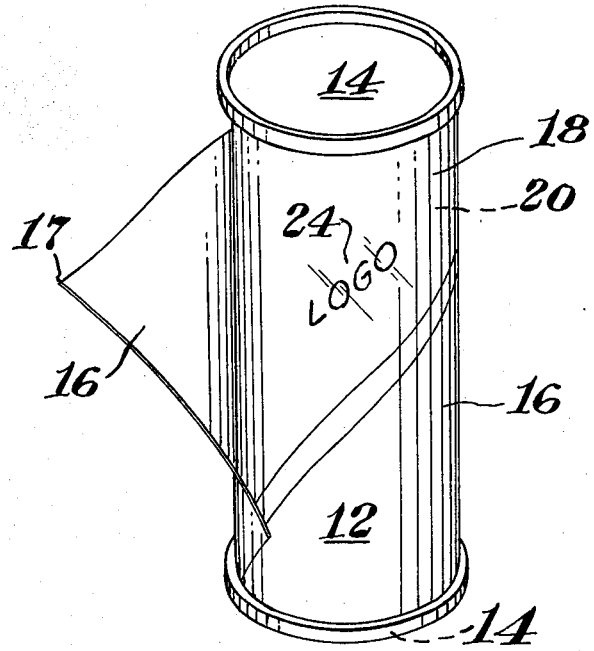
FIG. 3 is an isometric view of the container of FIG. 1 with the label ply partially removed.
Figure 2:
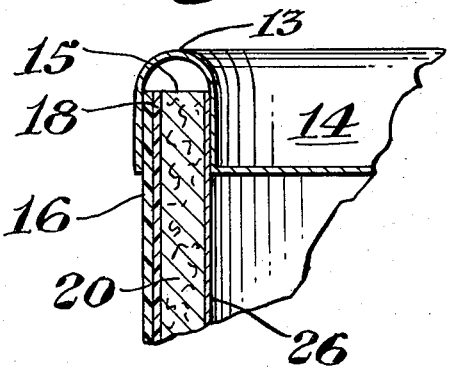
FIG. 2 is an enlarged fragmentary cross-sectional view through the sidewall of the container taken along the reference line 2—2 of FIG. 1.

*[5]EVA 3174 is DuPont ethylene-vinyl-acetate copolymer resin with 18% vinyl acetate; melt index of 8 g/10 min and a density of 0.94 g/cc ASTMD-792-60T This film formulation forming label ply 16 preferably has a high modulus, preferably is printable so that it can take graphics and is preferably opaque to reduce the amount ink needed and cover up the inside of the container. It is spirally wound upon itself and over the inner film ply 18 as shown in FIG. 1 and may be peeled from point 18 off the container as shown in FIG. 3. When it is so peeled, it exposes the film 18 which is preferably transparent. Because of this transparency, the graphics 24 which actually are printed on a base ply 20, are then viewable to the user. Such graphics containing, for example, instructions on how to twist or bang the container to further open the container as intended and as illustrated for example in FIG. 4.

The peel strength between the outer ply 16 and the inner ply 18 can range from about 0.05 psi to about 0.125 psi, for example, depending upon the formulation used and the glue adhering the film to the board stock. The glue can be, for example, National Adhesive No. 33-1774 Glue applied with a #16 myrod. Peel strength can be determined by pulling the outer ply from the inner ply in an Instron Tester using a 2 inch jaw separation and a cross-head speed of 10 in/min. If the inner ply and outer ply are formed by coextrusion into a multilayer material, by a coextrusion process such as taught in U.S. Pat. No. 3,354,506, then that material can be applied spirally about the can by passing the plies through a glue station holding the water base glue and then winding the label around the forward moving and rotating body stock in a traditional fashion. The actual containers are then cut from this composite tube and end sections or lids are put onto the cans.

While certain representative embodiments and details have been shown for purposes of illustrating the invention, it will be apparent to those skilled in the art that various changes in applications can be made therein without departing from the spirit and scope of the invention. The plies can be made of various equivalent materials and provide the same benefits and effects claimed, the size and pigments of the components can be varied to fit the size quantity of materials to be packaged, and the actual design and configuration of the container can vary provided it is opened in a similar manner. For example, while rubber-modified polystyrene resin makes an excellent base for the outer ply, other modified polystyrene resins or other high modulus resins can be effectively used. The titanium dioxide is very effective at increasing opacity. Other additives for increasing opacity could also be used. The resin used for inner film ply 18 can also be loaded into the resin blend of the outer label ply to achieve better overall economics by making use of the unused portions of the film and for increasing the peel strength between the two film plies. Ethylene vinyl acetate resin or other adhesive-type resin copolymers can also be added in the outer film layer or inner film ply or both to improve the film peel strength.

What is claimed as new is:

1. A multi-ply spirally wound container openable by rupture of ply seams comprising a base fibrous ply, an inner thermoplastic film ply adhered to and surrounding the base ply, said inner film ply being transparent film, the exterior of the base ply containing graphics readable through the inner film ply, an outer film ply surrounding the inner film ply, said outer film ply being peelable from the inner film ply, the inner film ply being of such a strength and gauge that it can rupture together with the base ply when the container is twisted or hit upon a hard object, said container being closed at both ends thereof to contain product therein.

2. The structure of claim 1 wherein the inner film ply has a thickness of about 0.2 mil to about 0.4 mil and the base fibrous ply is thin and smooth surfaced.

3. The structure of claim 1 wherein the inner film ply comprises a coextruded thermoplastic film material wherein one layer is a corona discharge-treated low density of polyethylene film and another layer of which is a layer of general purpose polystyrene film.

4. The container of claim 1 wherein a metal foil liner is adhered to the inner surface of the base ply.

5. The structure of claim 1 wherein the inner film ply comprises a multilayered structure of polyethylene film and impact polystyrene film.

6. The structure of claim 1 wherein the inner film ply comprises a corona discharge-treated low density polyethylene film and the outer film ply comprises a blend, the major component of which is impact polystyrene.

* * * * *